US008256731B2

(12) United States Patent
Wickwire

(10) Patent No.: US 8,256,731 B2
(45) Date of Patent: Sep. 4, 2012

(54) ADJUSTABLE PAINT BUCKET STAND

(76) Inventor: Tracy A. Wickwire, Mt. Hood, OR (US)

( * ) Notice: Subject to any disclaimer, the term of this patent is extended or adjusted under 35 U.S.C. 154(b) by 106 days.

(21) Appl. No.: 12/904,243

(22) Filed: Oct. 14, 2010

(65) Prior Publication Data

US 2011/0089295 A1 Apr. 21, 2011

Related U.S. Application Data

(60) Provisional application No. 61/252,546, filed on Oct. 16, 2009.

(51) Int. Cl.
*A47B 91/00* (2006.01)
*A47G 29/00* (2006.01)
*B65D 19/00* (2006.01)

(52) U.S. Cl. ..... 248/346.07; 248/148; 248/237; 248/346.01; 248/346.03; 108/2; 108/6

(58) Field of Classification Search ..... 248/148, 248/237, 346.01, 346.03, 346.07; 108/42, 108/2, 5, 6; 211/133.1, 133.4, 133.6
See application file for complete search history.

(56) References Cited

U.S. PATENT DOCUMENTS

| | | | | | |
|---|---|---|---|---|---|
| 1,650,433 | A * | 11/1927 | Dages | 248/148 |
| 2,750,139 | A * | 6/1956 | Young | 248/148 |
| 3,866,715 | A | 2/1975 | Foulk | |
| 4,842,229 | A * | 6/1989 | Murray | 248/148 |
| 4,856,745 | A * | 8/1989 | Mabie | 248/237 |
| 4,998,696 | A * | 3/1991 | Desjardins | 248/146 |
| 5,249,397 | A * | 10/1993 | Monaco | 52/126.1 |
| 5,558,306 | A * | 9/1996 | Binford et al. | 248/148 |
| 5,913,782 | A * | 6/1999 | Monaco et al. | 52/126.1 |
| 5,934,627 | A * | 8/1999 | Lewis et al. | 248/148 |
| 6,533,227 | B1 * | 3/2003 | Rom | 248/148 |
| 6,732,480 | B1 * | 5/2004 | Smith et al. | 52/126.1 |
| 6,926,241 | B2 | 8/2005 | Garrett | |
| 7,494,097 | B2 * | 2/2009 | Lidie et al. | 248/126 |
| 7,494,103 | B1 * | 2/2009 | Huebner | 248/346.07 |
| 7,887,016 | B2 * | 2/2011 | Gunsaullus | 248/238 |
| 2002/0027091 | A1 * | 3/2002 | Brown | 206/372 |
| 2006/0226310 | A1 * | 10/2006 | Hall et al. | 248/148 |
| 2009/0078165 | A1 * | 3/2009 | Tseng | 108/6 |

* cited by examiner

*Primary Examiner* — Terrell McKinnon
*Assistant Examiner* — Michael McDuffie

(57) ABSTRACT

In a preferred embodiment, the present invention comprises a device for holding a paint bucket and the like on an inclined surface. The device comprises a generally rectilinear and horizontal support surface having four edges with vertical sidewalls extending upward from each edge of the support surface. At the front edge a pair of downward extending feet protrude. At the rear edge of the support surface a rear-leg assembly extends downward from the support surface. The support surface further includes an adjustable armature and two rigidly mounted stops. The armature and two stops cooperate to selectively hold a paint bucket and can be adjusted for varying sized buckets. The armature includes an adjuster for selectively locking the armature. The rear leg assembly pivotally mounts to the support surface allowing the support surface to remain horizontal when the device is resting on an inclined surface such as a sloped roof.

8 Claims, 7 Drawing Sheets

ADJUSTABLE PAINT BUCKET STAND

PRIORITY CLAIM

The present application claims benefit under 35 USC Section 119(e) of U.S. Provisional Patent Application Ser. No. 61/252,546 filed on 16 Oct. 2009. The present application is based on and claims priority from these applications, the disclosures of which are hereby expressly incorporated herein by reference.

BACKGROUND

The present invention relates to adjustable platforms for holding a bucket and the like on an inclined surface, such as a roof.

A problem persists in providing a suitable platform for using a paint bucket on an inclined surface, such as a roof. A painter, handyman, or homeowner will, from time to time, need to re-paint, paint, caulk or otherwise repair a portion of their home accessible from the roof—for example, a dormer window, a chimney, or other similar feature. And, therein lies the problem in the current art: there is a lack of a small, easy to handle, and easy to carry up a ladder tool, platform, or device, that will enable the repair person to place a bucket of paint on a generally flat and level and horizontal orientation when working on a roof.

In broader scope, the prior art recognizes that roofers need a stable platform on which to stand when roofing, other examples recognize that building materials and tools need a horizontal platform during roofing, and yet other prior art examples provide hanging devices that attach to ladders or scaffolds. Yet, each of these examples (discussed in detail, below), do no address the need for a small, compact, lightweight, easy to carry device that readily adjusts to different sloped roofs to present a flat, horizontal, stable platform sized to hold a bucket of paint and the like.

For example, U.S. Pat. No. 3,866,715 issued to Foulk on 1975-02-18 describes an adjustable roofing platform. The Foulk device is not well suited for, and does not address the current problem. Foulk teaches a roofing platform consisting of three steel frames that cooperate to adjust to any roof slope. However, additional elements of the Foulk device render it quite limiting in its application, overly complex to use, and too cumbersome for the current problem. For example, Foulk further instructs that one frame lies against the roof. A second frame is generally L-shaped with a vertical riser and a horizontal stage bracket. The bottom of the riser is pivotally connected to the top of the roof frame. A diagonal brace is pivotally connected to the top of the riser and can be connected to a mid portion of the roof frame in any of a number of positions so that the riser remains vertical on any roof slope. Spikes on the bottom of the riser embed in the roof to keep the platform from sliding. Since these spikes are provided only at the top of the portion engaging the roof they can be fitted beneath the flaps of composition shingles and the platform can be used on a completed roof. A flat stage is mounted on the stage bracket in any of a number of positions forwardly from the roof frame so that the front edge of the stage is quite close to the roof to keep the roofing platform from tipping.

Recognizing the need for a smaller, more compact and yet still adjustable platform for supporting paint buckets on sloped surfaces, U.S. Pat. No. 4,842,229 to Murray issued on 1989-06-27 teaches an adjustable roof platform including a horizontal base with vertical rod receiving female members. The base is made of a reinforced frame with an expanded metal platform. An upright wall is affixed to the metal platform to support paint buckets. At least one adjustable rod is slidable in the female member to adjust the horizontal base to the angle of pitch of the roof. A locking thumbscrew is threaded into the female member to engage the rod, locking it in place. The rod has a roof-engaging end with a point to slightly embed itself in the roof. However, the Murray device is cumbersome to adjust and overly complex to operate.

Other attempts in the prior-art include the adjustable support for holding a paint bucket or other container disclosed by Rom in U.S. Pat. No. 6,533,227 issued on 2003-03-18 and the Roofmates Roofing Accessories of Garret disclosed in U.S. Pat. No. 6,926,241 issued on 2005-07-09.

Despite the current state-of-the art, there remains a need for a small, compact, lightweight platform that quickly and easily adjusts for various sloped roofs. There is a need for a horizontal platform that further adjusts for different sized paint buckets.

DRAWING

DESCRIPTION OF THE INVENTION

Possible preferred embodiments will now be described with reference to the drawings and those skilled in the art will understand that alternative configurations and combinations of components may be substituted without subtracting from the invention. Also, in some figures certain components are omitted to more clearly illustrate the invention.

FIGS. 1 through 7 illustrate a preferred embodiment of the present invention. The present invention contemplates a bucket support for use on a sloped surface. For example, a device 10 that can be used to hold a bucket of paint (quart, or gallon buckets, for example) on a roof. Accordingly, the device 10 includes a support surface 12 that is a substantially planar, flat, rectangular, and preferably, square platform well suited to hold a full gallon of paint. The majority of the components of this device are molded from ABS resin, or other similar material. Of course, the device could made equally well for its intended purpose from other materials including wood, metal, synthetic materials, composites, metal alloys, other plastic, and the like. The preferred embodiment is scaled to hold both a quart sized bucket and a gallon bucket, but it could readily be scaled for larger buckets, including a 5-gallon bucket or other sizes depending on the need.

Figure 1:
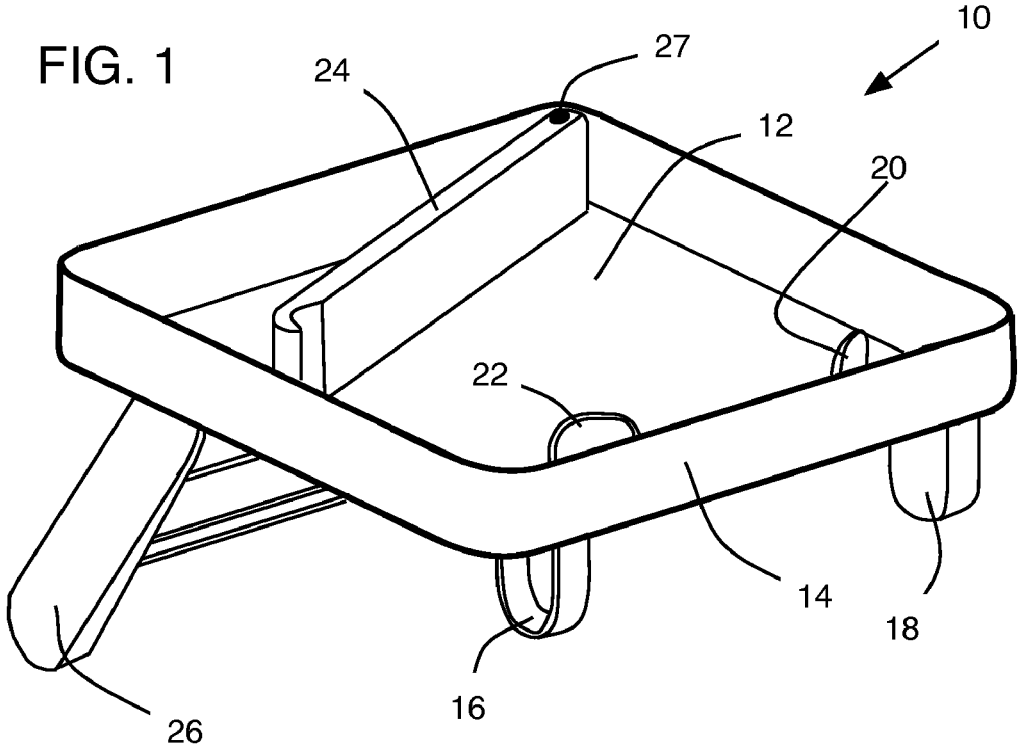
FIG. 1 is an offset frontal view of a preferred embodiment of the present invention

An overview of the device, as illustrated particularly in FIG. 1, reveals a horizontal support surface 12 having four edges arranged in a square (or rectilinear) form. From this support surface a pair of front feet extend downward. Each foot, the first foot 16 and the second foot 18 is disposed on the underside of the horizontal surface adjacent to, or coincident to the front edge. The first foot and second foot are spaced apart from each other along the front edge to provide a stable platform when used to hold a bucket of paint on a roof. As illustrated, each respective first and second foot are near the respective left and right edges of the support platform, but do not arrange coincident to the two corners defined by the front edge and the left and right edges. The placement of the first foot and second foot is not critical to the scope and spirit of the invention—those skilled in the art would understand that there are many suitable placements of the front feet that will still ensure a stable platform when used on a flat or sloped surface, as intended by the present invention.

Both the first foot 16 and second foot 18 further comprise a generally vertical leg portion extending substantially perpendicular from the bottom of the support surface or, alternatively from a combination of the front edge and bottom side of the support surface. Each respective first and second leg is generally U-shaped. In other contemplated embodiments, these legs may comprise a sub-assembly that are coupled to the support surface by any known means including fasteners, snap-fit, riveting, press fit, and the like. However, in a preferred embodiment the legs are injection molded as an integral unit with the platform. At the bottom of each U-shaped leg, the foot further includes a friction-enhancing surface. One suitable friction-enhancing surface is a high-density, textured neoprene foam rubber with self-adhesive. This includes a self-adhesive surface that chemically bonds the backside of the gripping surface to the respective foot. In other contemplated embodiments, the gripping surface can be machined or molded into the foot in the form of grooves, crosshatches, etc.

Still referring to FIG. 1, a pair of bucket engaging rests, or a first block 20 and second block 22 each protrude and extend upward from the support surface 12. Each block is substantially rectangular with a length greater than its height, and a relatively thin cross section. Each block arranges on a common radius and forms a barrier or stop or similar opposition to a bucket when placed on the support surface, and the blocks are arranged to center the bucket left-to right to enhance stability of the device 10 when use on a sloped surface. Each block further includes a pad on its inside face this pad cushions the bucket. Alternatively, the pad comprises the same friction-enhancing surface common to the front fee. Although the blocks 20 and 22 are illustrated as rectilinear stops, other shapes would work equally well in other contemplated embodiments including a pair of cooperating pegs, for example.

Although not depicted in FIG. 1, the support surface further includes a slot, which is discussed in detail subsequently herein.

Still referring to FIG. 1, the device 10 includes a movable armature 24 having a proximal end pivotally mounted to the horizontal surface, the movable arm further including an adjuster (not shown in FIG. 1). The device further includes a rear-leg assembly 26 extending downward from the horizontal surface at a rear edge, the rear edge being opposite the front edge.

A preferred embodiment of the device 10, as FIG. 1 illustrates, includes at least one sidewall 14, and preferably four sidewalls, extending vertically from each corresponding edge of the horizontal support surface. The sidewalls are relatively squat and interconnected. However, in keeping with the spirit and scope of this invention, the sidewalls may be omitted or configured differently than illustrated and may include taller or shorter or combinations of tall and short sidewalls, or simply periodically spaced fence posts or pins. The walls may or may not be interconnected and may or may not be integrated into the support surface. A preferred embodiment contemplates integrated sidewalls formed during the molding process.

Figure 2:
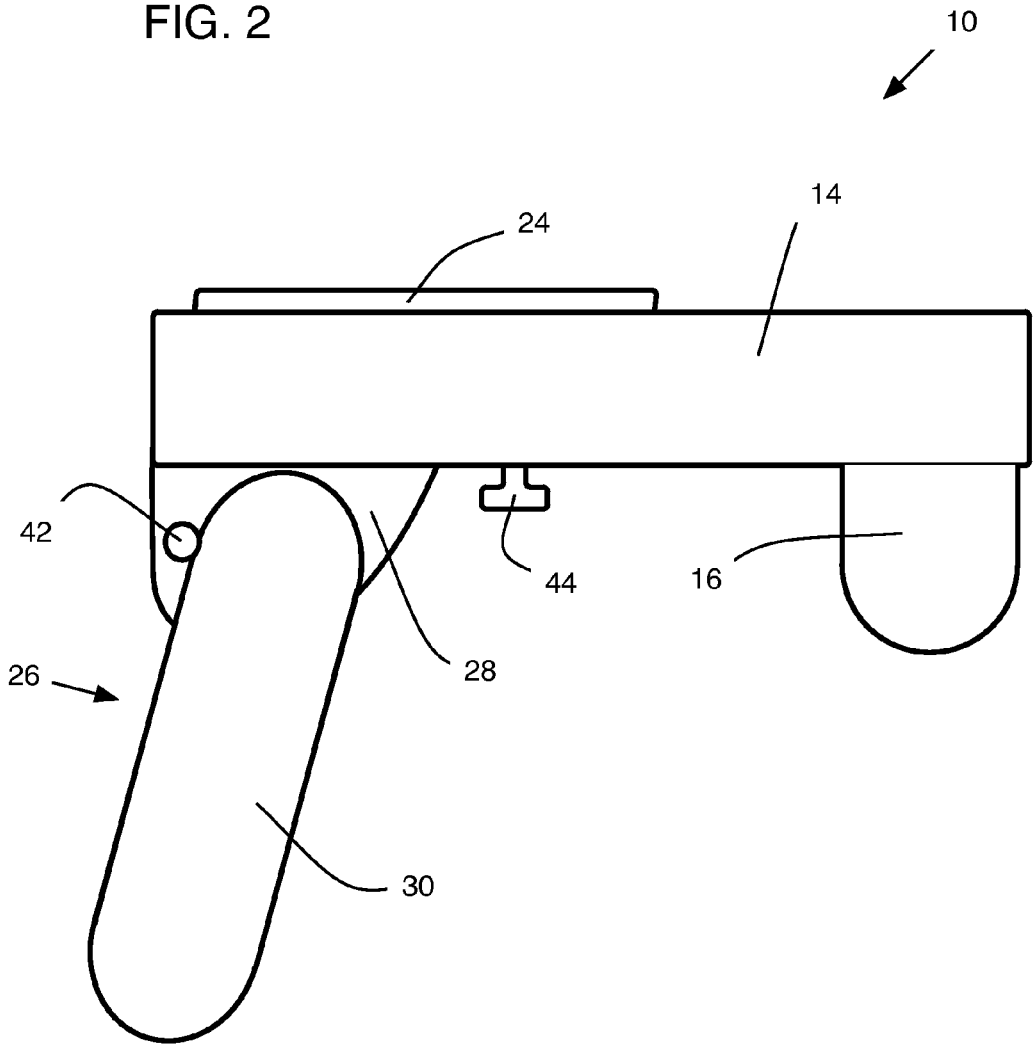
FIG. 2 is a left side view of the embodiment of FIG. 1.

Now, making reference to FIG. 2 showing a left side, the device 10 is generally symmetric left—to right. That is to say, the left side and right side are substantially mirror images of each other. And, any differences between the left and right sides are inconsequential to the spirit and scope of this invention. The device includes at least one sidewall (generally indicated as sidewall 14) extending vertically from the support platform (not shown in this view). The sidewall generally runs substantially the entire length of the platform. The armature 24 may be slightly taller than the side wall, as shown, or it may be any other dimension, as long as it is operable to help snug a bucket against the front stops, as previously discussed. The adjuster 44 of the armature 24 extends beneath the support surface at the slot 23 (not visible in this view). A biasing means for motivating the armature toward the front stops is omitted from this view. The biasing means, for example, a coil-wound spring element 50 (of FIGS. 3 and 6, for example), connects from the protruding adjuster 44 to the first foot 16.

FIG. 2 also shows a side view of the first front foot 16 with its generally U-shaped profile.

The rear leg assembly 26, as FIG. 2 shows in profile, is generally symmetric left to right, and for brevity only the left side is described in detail, it being understood that the right side substantially shares constructs and includes similar and/or identical components. The rear leg assembly, accordingly, includes a first rear leg 30 and a similarly configured, but not illustrated, second rear leg. The first rear leg pivotably mounts to a first rear leg carrier shoulder 28 having three mounting holes for a pivot protruding inward from the first leg. The carrier shoulder 28 further includes an outward protruding stop 44, which engages a portion of the first leg 30 to arrest unwanted rotation outward along a line radius having an axis running perpendicular to the page. The three mounting holes 48 (not shown in this view, but illustrated in FIG. 6, for example) on the carrier shoulder 28 enable a selective amount of rotation of the rear-leg assembly so that it readily adjusts to different sloped roofs, as will be further explained herein. Thus, the pivoting coupling means and adjusting means on the cooperating left and right sides of the rear leg assembly enable selective rotation of the rear leg assembly relative to the support platform an the rear leg assembly 26 is operable in a first position, a second position and an intermediate position.

Figure 3:
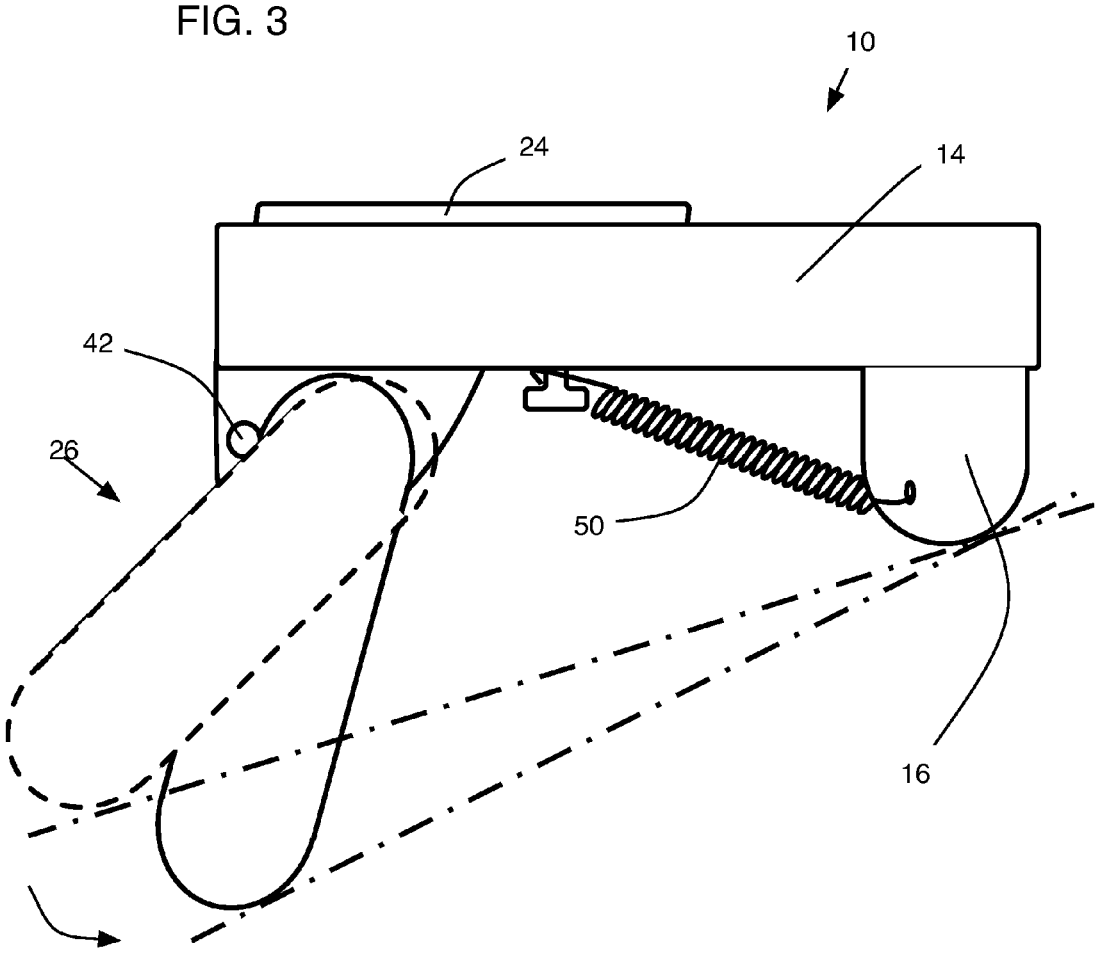
FIG. 3 is an alternative left side view of the embodiment of FIG. 1, showing the adjustability of the rear-leg assembly.

FIG. 3 better illustrates the adjustment of the rear leg assembly, which is restricted from overextension rearward by the stop 42 protruding from the first carrier shoulder 28. The device 10 adapts for differing pitches in roof by the rotation of the rear leg assembly 26 cooperating with the pivot mounting position of the corresponding first and second rear leg at a top portion.

Figure 7:
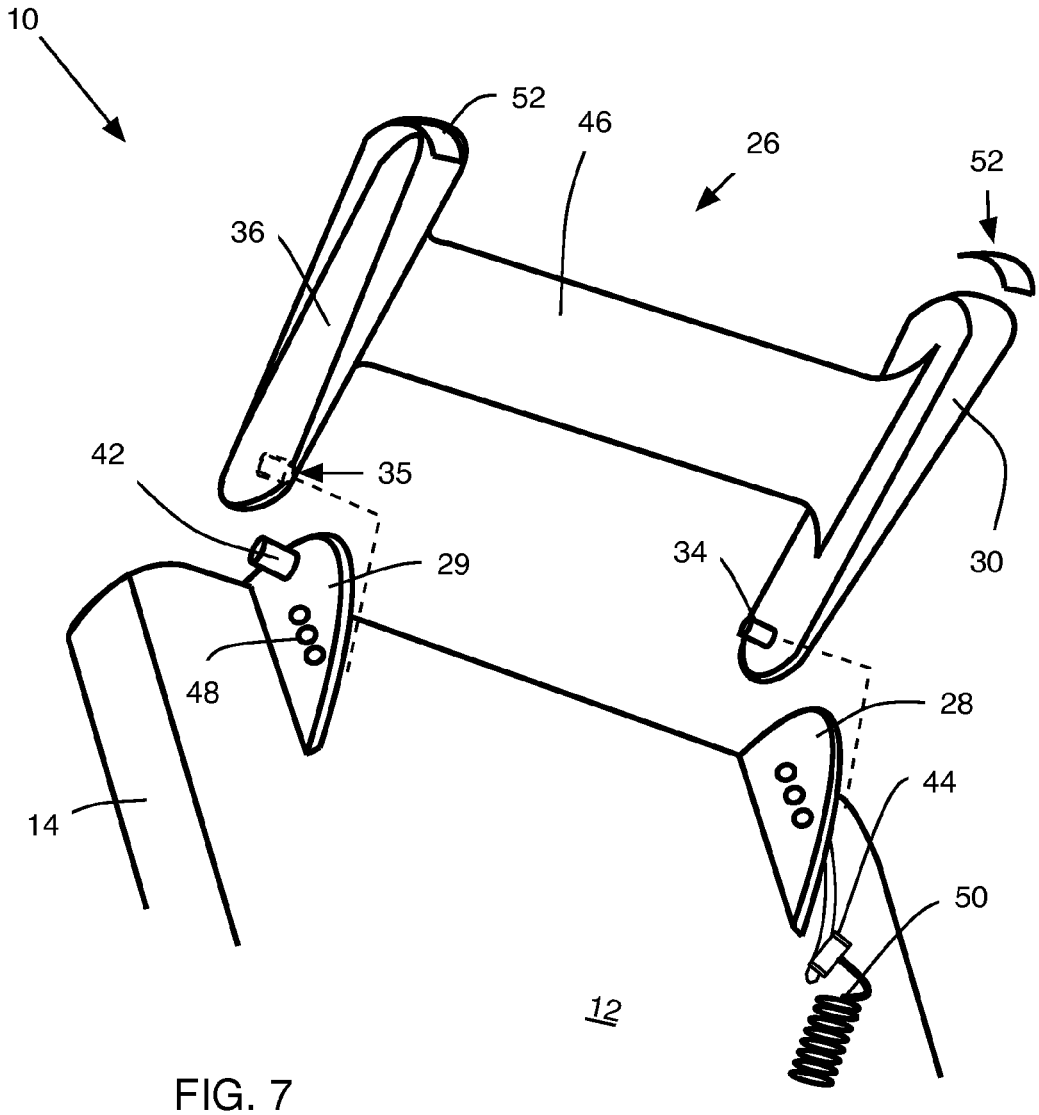
FIG. 7 is a second partial bottom view of the embodiment of FIG. 1.

FIG. 7 further details the relationship of the rear leg assembly 26 to the support surface 12. The first leg 30 is coupled to the second leg 36 by means of a horizontal truss element 46. Each respective leg includes an inwardly protruding pivot mount 34 and 35. In turn, each respective pivot mount selectively engages any one of the three mounting holes 48 on the corresponding carrier shoulder 28 or second shoulder 29. At least one shoulder, either shoulder 28 or 29, or both, includes a stop 42.

Figure 4:
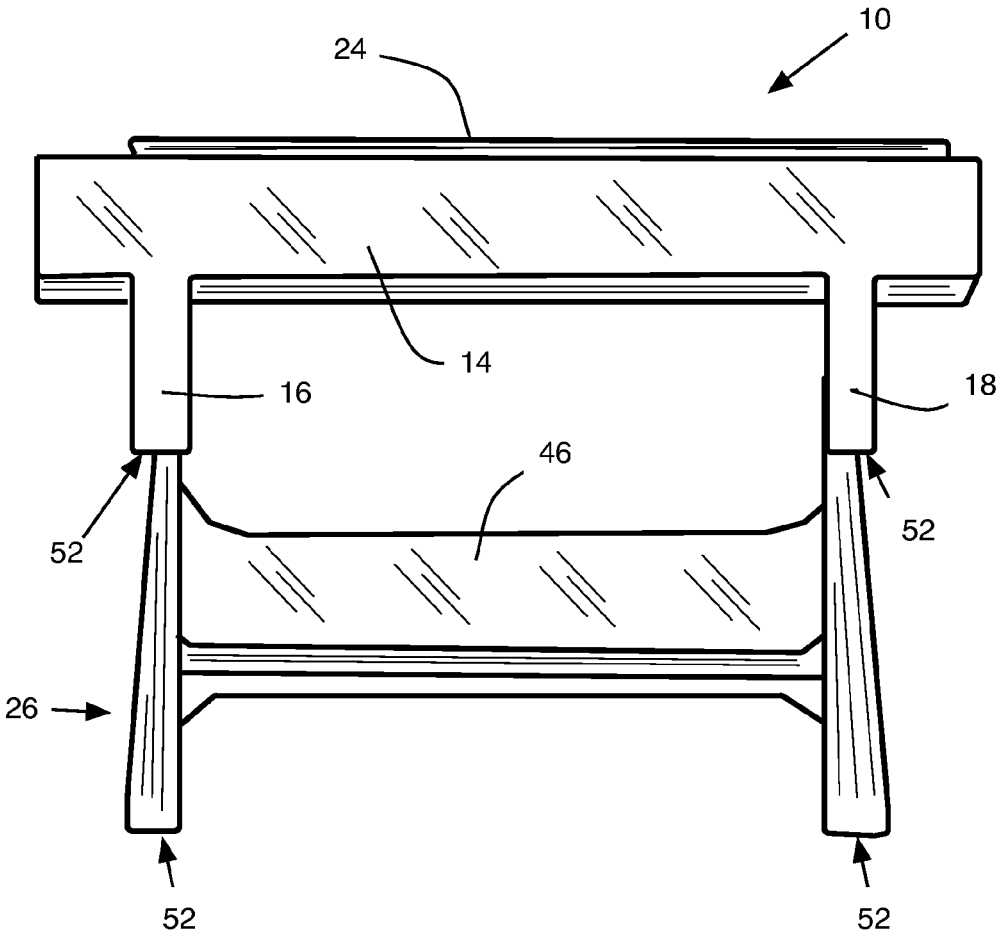
FIG. 4 is a front view of the embodiment of FIG. 1.

FIG. 4 shows the rear leg assembly 26 from the front in relation to the support platform, which is surrounded by sidewalls 14. The rear leg assembly extends downward from the plane defined by the horizontal support surface. Viewing FIGS. 3, 4, and 7 together, it is apparent that the rear leg assembly 26 includes a first rear leg 30, which is pivotably mounted to the horizontal surface at a first location consisting of the shoulder 28 having at least one hole 28 (a preferred embodiment includes three linearly aligned holes on the should, but one, two, four, or more holes would work equally well). The rear leg assembly further includes a second rear leg 36, which is pivotably mounted to the horizontal surface at a second location consisting of the second carrier shoulder 29 having the same number and configurations of mounting holes as the first rear leg. The rear leg assembly further includes a horizontal cross member 46 linking the first rear leg at an intermediate position on the first leg to the second rear leg at an intermediate position on the second leg. Each respective rear leg terminates in a foot. The first rear leg terminates at a first rear foot having a friction enhancing surface 52, and the second rear leg terminates at a second rear foot have a similar friction enhancing surface. As discussed relative to the front feet, the gripping surface 52 can include a high-density neoprene foam with self-adhesive.

Figure 5:
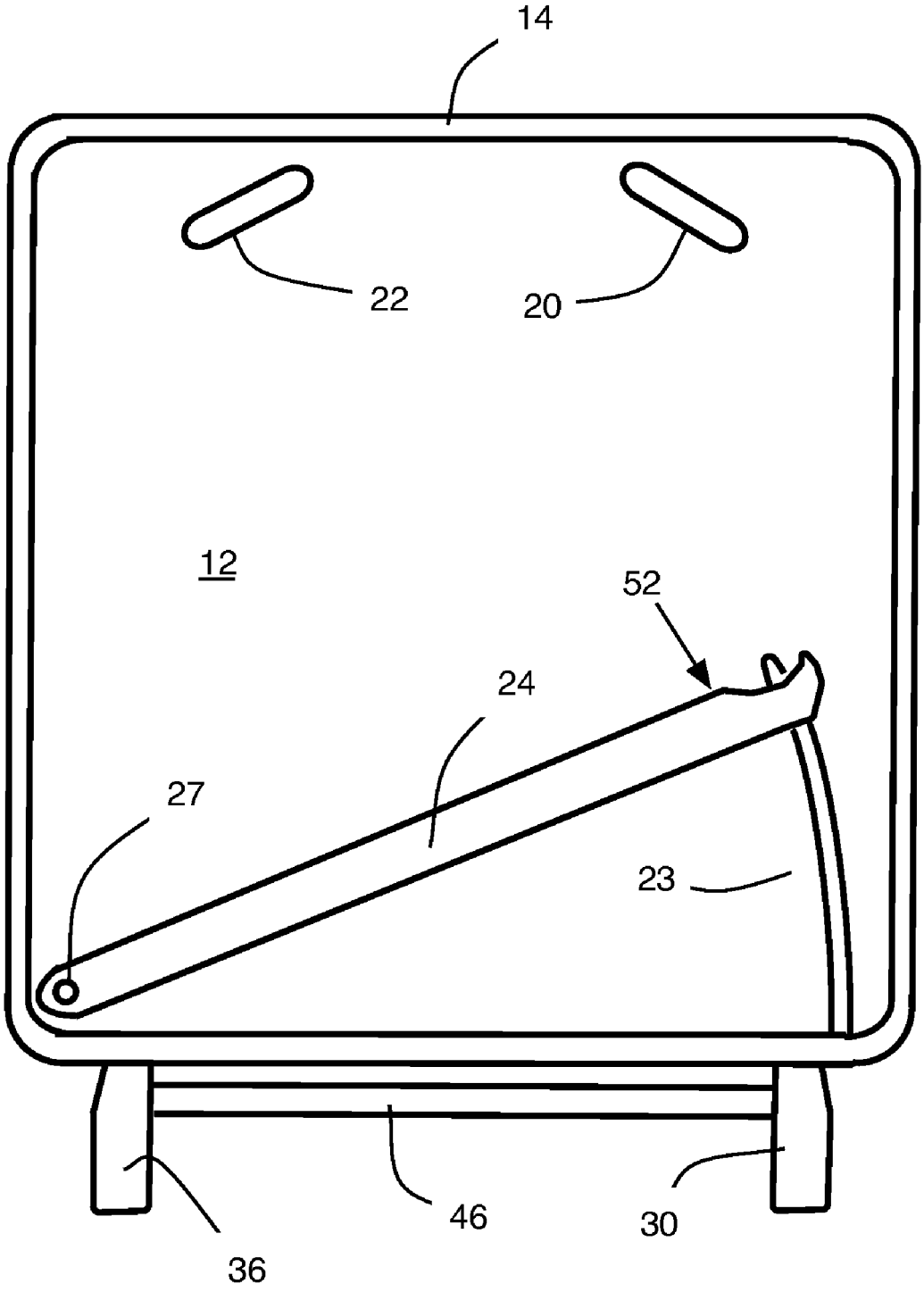
FIG. 5 is a top view of the embodiment of FIG. 1.

FIG. 5, a top view of the device 10, shows the flat, rectangular (preferably square) support surface 12 surrounding by a corresponding sidewall 14 extending vertically from each edge of the horizontal support surface. The armature 24 includes a pivot post 27, which pivotably secures the armature at one end. The second end of the armature follows the slot 23 inscribed in the support surface 12. As illustrated in FIGS. 2 and 3, for example, the armature 24 further includes a downwardly protruding adjuster 44, which is adapted to slide in the slot and enable the armature second end to follow a radius or path of the slot. The biasing means 50 urges the armature forward toward the cooperating stops 20 and 22. The selective adjustability of the armature enables snug placement of either a quart sized bucked or a gallon bucket or any similarly sized or range of sizes buckets and the like on the support surface. Not shown in the figures, the front face of the armature includes a friction-enhancing surface 52, such as a high-density neoprene foam with self-adhesive. The armature, with the biasing member, cooperates with the stops to secure a bucket on the support surface.

One benefit of the spring-loaded armature combined with the front stops each having a friction-enhancing surface facing the bucket, enables the user to lift the bucket and tray (support surface) as one unit. Thus, the biasing member must have sufficient spring-strength to urge the armature forward and hold fast against even a full paint bucket.

Figure 6:
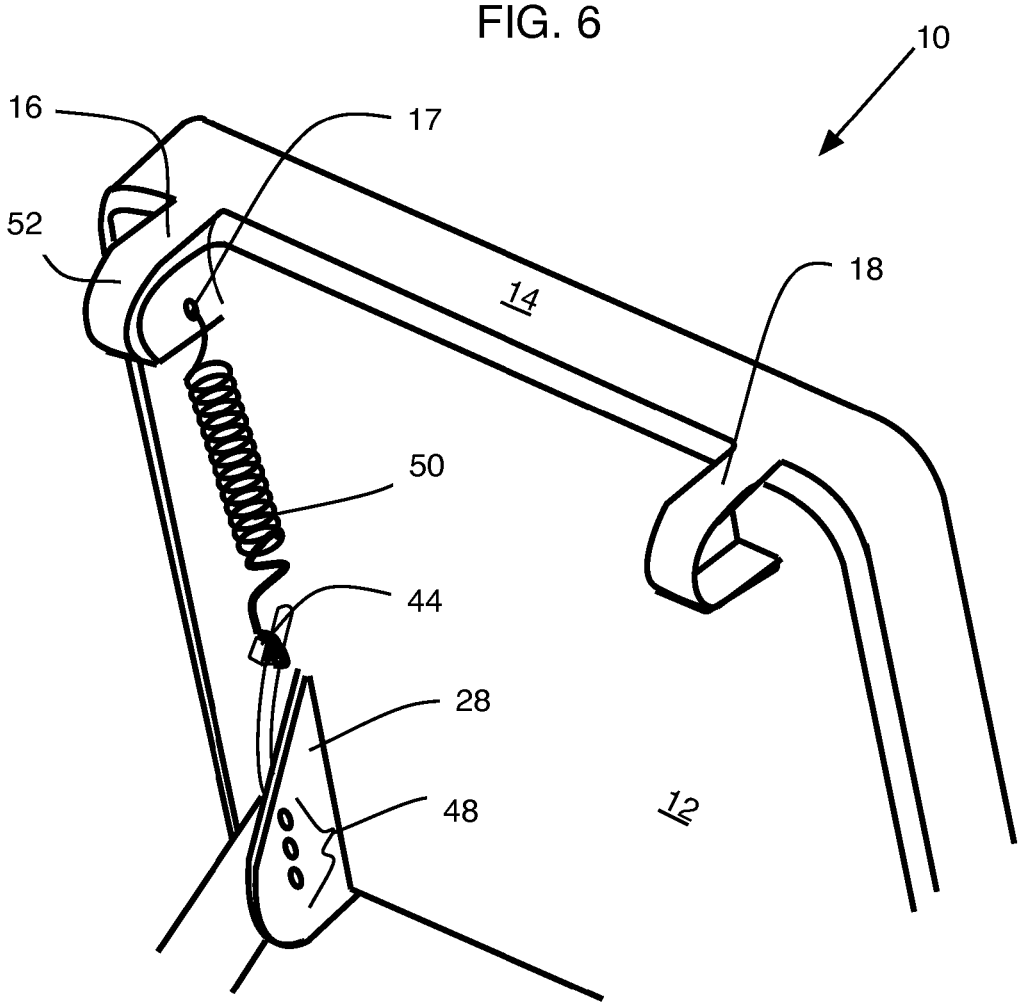
FIG. 6 is a partial bottom view of the embodiment of FIG. 1.

FIG. 6, a partial bottom view of the support surface 12, illustrates the biasing spring 50 having a first end coupled to the first foot 16 at a mounting hole 17 and a second end coupled to the adjuster 44.

In other contemplated embodiments, the armature—instead of pivotably mounted to the support surface by a pin/post arrangement may include a arcuate arm, or a straight arm or variation thereof having a biasing means that urges the armature toward the first and second blocks. The biasing means would cause the armature, cooperating with the blocks, to pinch or otherwise constrain a paint bucket therebetween. Ideally the biasing means would have sufficient force to enable a user to pick up a full paint bucket and have the support surface stay attached to the bucket by means of the armature and cooperating blocks. Thus, a spring, or a ratchet device could be adapted for this purpose. In other embodiments, the biasing means may not have sufficient tension to hold a bucket in place when the bucket is lifted from the support surface.

In other alternative embodiments, the support surface can include a vertical wall extending from and edge, having an outward facing hook or pair of hooks that enable the support platform to hang from a rung of a ladder, for example. In yet another embodiment, a sidewall can be modified to include a rotatable sub-platform that enables the horizontal support surface to adapt for use on a ladder or on an inclined roof.

Although the invention has been particularly shown and described with reference to certain embodiments, it will be understood by those skilled in the art that various changes in form and detail may be made without departing from the spirit and scope of the invention.

I claim:

1. An improved device for holding a paint can on an inclined surface, the device comprising: a horizontal support surface; a first support foot extending downward from a front edge of the horizontal support surface; a second support foot extending downward from the front edge of the horizontal support surface; a first block protruding from the horizontal support surface adjacent to the front edge, the first block having a friction enhancing surface on a side facing inward toward the center of the device; a second block protruding from the horizontal support surface adjacent to the front edge and arranged on a radius common to the first block, the second block having a friction enhancing surface on a side facing inward toward the center of the device; a movable armature having biasing means for urging the movable armature forward toward the first and second blocks, the armature further including a friction enhancing surface on a front side of the armature; and a rear-leg assembly extending downward from the horizontal surface at a rear edge, the rear edge being opposite the front edge, the rear-leg assembly pivotally coupled to the horizontal support surface wherein the rear leg assembly being operable in at least a first position; and the armature further comprises a proximal end pivotably coupled to the horizontal support surface at a position adjacent to two intersecting edges, and a distal end having a front face, the front face including a friction enhancing material and whereby the distal end follows a radius defined by the length of the armature from the proximal end's pivotably coupled position to the distal end of the armature, the radius extending toward at least one of the first or second blocks.

2. An improved device for holding a paint can on an inclined surface, the device comprising: a horizontal support surface; a first support foot extending downward from a front edge of the horizontal support surface; a second support foot extending downward from the front edge of the horizontal support surface; a first block protruding from the horizontal support surface adjacent to the front edge, the first block having a friction enhancing surface on a side facing inward toward the center of the device; a second block protruding from the horizontal support surface adjacent to the front edge and arranged on a radius common to the first block, the second block having a friction enhancing surface on a side facing inward toward the center of the device; a movable armature having biasing means for urging the movable armature forward toward the first and second blocks, the armature further including a friction enhancing surface on a front side of the armature; and a rear-leg assembly extending downward from the horizontal surface at a rear edge, the rear edge being opposite the front edge, the rear-leg assembly pivotally coupled to the horizontal support surface wherein the rear leg assembly being operable in at least a first position; a slot disposed in the horizontal support surface; and wherein the armature further comprises a proximal end pivotally mounted to a the horizontal surface, the movable armature further including an adjuster extending downward from a distal end of the armature, the adjuster protruding below the support surface and being operable to slide in the slot, the adjuster further coupling to a biasing means for moving the armature toward the first block, the biasing means comprising a spring having a first end coupled to the adjuster and a second end coupled to a feature on the device wherein the armature is pulled toward the front of the horizontal support surface.

3. The device of claim 1 further comprising:

at least one sidewall extending vertically from at least one edge of the horizontal support surface.

4. The device of claim 1 further comprising:

a corresponding sidewall extending vertically from each edge of the horizontal support surface and wherein the support surface is generally rectilinear when viewed from the top.

5. The device of claim 1 further comprising:

a first rear leg, pivotably mounted to the horizontal surface at a first location and extending downward therefrom;

a second rear leg pivotably mounted to the horizontal surface at a second location and extending downward therefrom;

a horizontal cross member linking the first rear leg at an intermediate position on the first leg to the second rear leg at an intermediate position on the second leg; and wherein the first rear leg terminates at a first rear foot having a friction enhancing surface, and the second rear leg terminates at a second rear foot have a friction enhancing surface.

6. The device of claim 1 wherein:

at least one gripping element couples to a bottom surface of the first foot.

7. The device of claim 1 wherein:

the movable armature further includes an adjuster extending downward from a distal end of the armature; and the biasing means comprises a coil spring having a first end coupled to a lower end of the adjuster and a second end couples to a lower portion of the first support foot.

8. The device of claim 1 having a rear leg assembly being operable in at least one position further comprising:

a first rear shoulder extending downward from the horizontal surface from a first portion from an underside of horizontal surface and having a first pivot mount;

a second rear should extending downward from the horizontal surface from a second portion from the underside and having a second pivot mount;

the first shoulder further includes a stop protruding from the shoulder adjacent to the first pivot mount.

* * * * *